US011820560B2

(12) United States Patent
Teshima

(10) Patent No.: US 11,820,560 B2
(45) Date of Patent: Nov. 21, 2023

(54) LIQUID STORAGE BOTTLE

(71) Applicant: CANON KABUSHIKI KAISHA, Tokyo (JP)

(72) Inventor: Takayuki Teshima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 310 days.

(21) Appl. No.: 17/173,099

(22) Filed: Feb. 10, 2021

(65) Prior Publication Data

US 2021/0253312 A1 Aug. 19, 2021

(30) Foreign Application Priority Data

Feb. 19, 2020 (JP) ..... 2020-026484

(51) Int. Cl.
*B65D 47/10* (2006.01)
*B41J 2/175* (2006.01)

(52) U.S. Cl.
CPC ..... *B65D 47/103* (2013.01); *B41J 2/1754* (2013.01); *B41J 2/17509* (2013.01); *B41J 2/17553* (2013.01); *B65D 2251/20* (2013.01)

(58) Field of Classification Search
CPC .... B41J 2/175; B41J 2/17503; B41J 2/17506; B41J 2/17509; B41J 2/17513; B41J 2/17523; B41J 2/1754; B41J 2/17553; B41J 2/175496; B41J 29/13; B65D 47/103; B65D 47/24; B65D 2251/20
See application file for complete search history.

(56) References Cited

U.S. PATENT DOCUMENTS

| | | | | |
|---|---|---|---|---|
| 8,419,173 | B2 * | 4/2013 | Hayashi | B41J 2/17536 347/85 |
| 9,254,671 | B2 * | 2/2016 | Okazaki | B41J 2/1752 |
| 9,315,034 | B2 * | 4/2016 | Ono | B41J 2/17596 |
| 10,350,896 | B2 | 7/2019 | Ishizawa et al. | B41J 2/17509 |
| 2008/0170108 | A1 | 7/2008 | Lee et al. | 347/85 |

FOREIGN PATENT DOCUMENTS

| | | |
|---|---|---|
| JP | 2006-218839 | 8/2006 |
| JP | 2009-154416 | 7/2009 |
| JP | 2017-197197 | 11/2017 |
| JP | 2018-144281 | 9/2018 |

OTHER PUBLICATIONS

Office Action dated Sep. 26, 2023 in counterpart Japanese Application No. 2020-026484, together with English translation thereof.

* cited by examiner

*Primary Examiner* — Anh T Vo
(74) *Attorney, Agent, or Firm* — Venable LLP

(57) ABSTRACT

Provided is a liquid storage bottle that can ensure sufficient sealing performance when a liquid tank is replenished with a liquid. A liquid storage bottle stores a liquid with which a liquid tank is replenished, has a bottle body and a discharge port that discharges a liquid stored in the bottle body, and has a discharge nozzle in which a liquid injection tube of the liquid tank can be inserted via the discharge port and an annular fixed seal member that is provided to the discharge port and seals a part between the discharge port and the liquid injection tube inserted in the discharge port. The fixed seal member has a plurality of annular seal portions that are arranged apart from each other in the axis direction of a discharge nozzle and are individually in contact with the liquid injection tube inserted in the discharge port.

13 Claims, 5 Drawing Sheets

LIQUID STORAGE BOTTLE

BACKGROUND OF THE INVENTION

Field of the Invention

The present invention relates to a liquid storage bottle.

Description of the Related Art

Some liquid tanks used in a liquid ejection apparatus such as an ink jet recording apparatus can be replenished with a liquid from a separately prepared liquid storage bottle. In such a liquid storage bottle for liquid replenishment, it is required to ensure sealing performance to the liquid tank during liquid replenishment in order to suppress a liquid to be replenished from being leaking outside. Japanese Patent Application Laid-Open No. 2018-144281 discloses a configuration to seal a part between a liquid storage bottle and a liquid injection tube of a liquid tank inserted in a discharge port during liquid replenishment by using an annular seal member provided at the discharge port of the liquid storage bottle.

SUMMARY OF THE INVENTION

A liquid storage bottle of the present invention is a liquid storage bottle storing a liquid that is a liquid with which a liquid tank is replenished, and the liquid storage bottle including: a bottle body; a discharge nozzle having a discharge port that discharges a liquid stored in the bottle body; and an annular fixed seal member, wherein the discharge nozzle is formed such that a liquid injection tube of the liquid tank is able to be inserted in the discharge nozzle via the discharge port, wherein the fixed seal member is provided in the discharge port and configured to seal a part between the discharge port and the liquid injection tube inserted in the discharge port, wherein the fixed seal member has a plurality of annular seal portions, and wherein the plurality of annular seal portions are arranged apart from each other in the axis direction of the discharge nozzle and configured to be in contact with the liquid injection tube individually.

Further features of the present invention will become apparent from the following description of exemplary embodiments with reference to the attached drawings.

DESCRIPTION OF THE EMBODIMENTS

Figure 1:
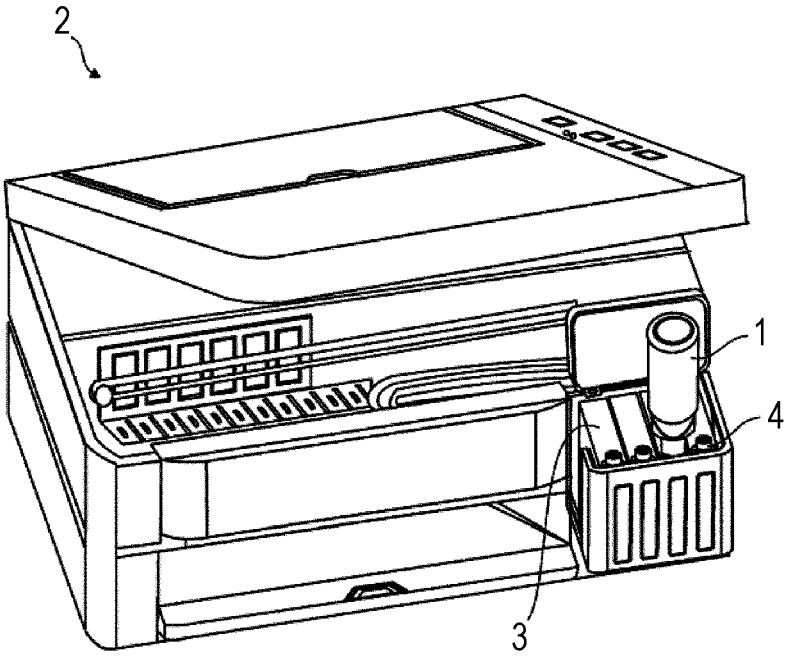
FIG. 1 is a perspective view of a recording apparatus in which a liquid storage bottle of the present invention is used.

In the configuration disclosed in Japanese Patent Application Laid-Open No. 2018-144281, when even only a single flaw occurs in a seal member due to involvement of a foreign material such as dust, there is a concern about liquid leakage occurring therefrom.

Accordingly, the object of the present invention intends is to provide a liquid storage bottle that can ensure sufficient sealing performance when a liquid tank is replenished with a liquid.

The embodiments of the present invention will be described below with reference to the drawings. In the present specification, while a case where an ink jet recording apparatus (liquid ejection apparatus) is replenished with ink (liquid) will be described as an example of a use of a liquid storage bottle of the present invention, the use of the liquid storage bottle is not limited thereto. Note that, in the following description, components having the same function are labeled with the same references in the drawings, and the description thereof may be omitted.

FIG. 1 is a perspective view of an ink jet recording apparatus in which the liquid storage bottle of the present invention is used, which is a diagram illustrating a view during liquid replenishment.

An ink jet recording apparatus 2 has a carriage (not illustrated) that can reciprocate in the main scanning direction, a recording head (not illustrated) that is mounted on the carriage and ejects ink in a form of liquid, and a large-capacity liquid tank 3 that stores an ejected liquid. When a liquid is ejected from an ejection port provided in the recording head during reciprocating scanning of the carriage, an image is recorded on a recording medium conveyed in the sub-scanning direction crossing the main scanning direction. The liquid stored in the liquid tank 3 is supplied to the recording head from a supply tube (not illustrated) via a small-capacity sub-tank (not illustrated) provided in the carriage. When the remaining level of the liquid in the liquid tank 3 is reduced, a user uses the liquid storage bottle 1, which stores the liquid to be replenished, to replenish the liquid tank 3 with the liquid through a liquid injection tube 4 protruding upward from the liquid tank 3.

Figure 2A:
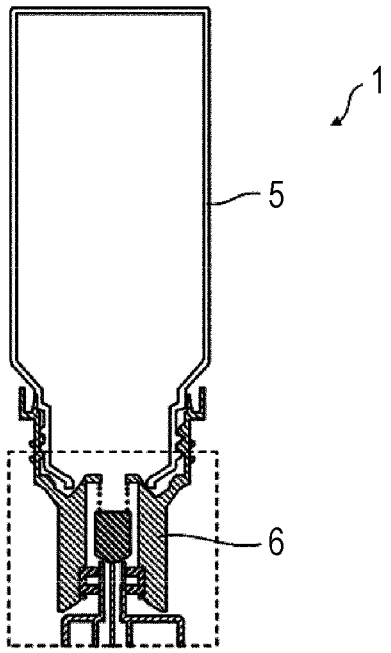
FIG. 2A and FIG. 2B are sectional views of a liquid storage bottle according to one embodiment of the present invention.
Figure 2B:
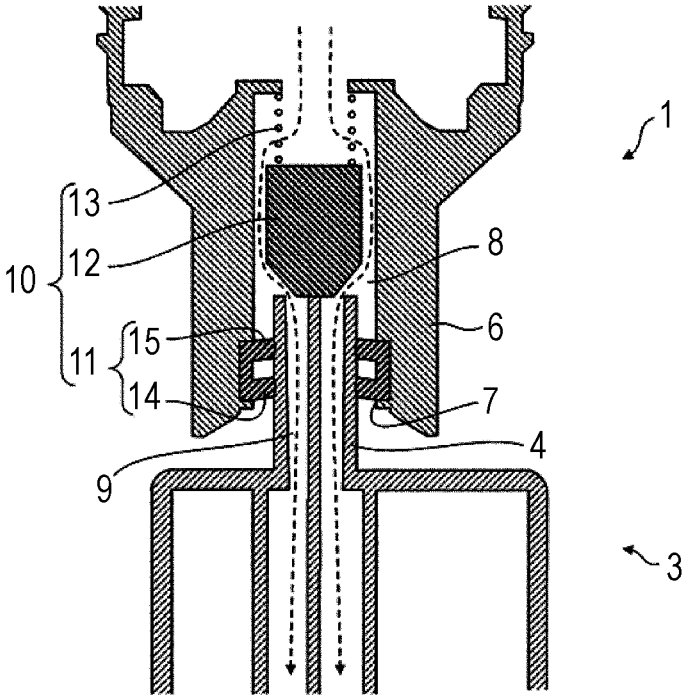

FIG. 2A is a sectional view of the liquid storage bottle according to one embodiment of the present invention, which is a diagram illustrating a view when connected to the liquid injection tube of the liquid tank for liquid replenishment. FIG. 2B is an enlarged view of a region surrounded by a dotted line in FIG. 2A.

The liquid storage bottle 1 has a cylindrical bottle body 5 that stores a liquid and a discharge nozzle 6 installed in an opening portion of the bottle body 5. In the discharge nozzle 6, a discharge port 7 that discharges a liquid stored in the bottle body 5, and a discharge channel 8 that communicates with the discharge port 7 are formed, and the liquid injection tube 4 of the liquid tank 3 can be inserted therein via the discharge port 7. Further, the liquid storage bottle 1 has a switching valve unit 10 that opens and closes the discharge port 7 of the discharge nozzle 6. The switching valve unit 10 has an annular fixed seal member 11 provided in the discharge port 7, a cylindrical movable seal member 12 provided so as to be movable in the axis direction of the discharge nozzle 6 in the discharge channel 8, and a spring member 13. The spring member 13 is stored in a discharge channel so as to push the movable seal member 12 against the fixed seal member 11. Accordingly, when the liquid storage bottle 1 is unused, the movable seal member 12 comes into contact with the fixed seal member 11 and closes the discharge port 7. As a result, for example, a sealing property to prevent leakage of the contents even when the liquid storage bottle 1 falls down is ensured.

On the other hand, when the liquid storage bottle 1 is used (during liquid replenishment), the liquid injection tube 4 of the liquid tank 3 is inserted in the discharge port 7, as illustrated. The movable seal member 12 is pushed up to the liquid injection tube 4 inserted in the discharge port 7, is separated from the fixed seal member 11, and thereby opens the discharge port 7. Accordingly, the discharge channel 8 of the discharge nozzle 6 and the inlet channel 9 of the liquid injection tube 4 communicate with each other, and as illustrated by two dotted line arrows in FIG. 2B, the liquid tank 3 is replenished with a liquid from the liquid storage bottle 1. At this time, since the fixed seal member 11 is in contact with the liquid injection tube 4, a part between the discharge port 7 and the liquid injection tube 4 is sealed, and leakage of the liquid in the liquid storage bottle 1 to the outside is suppressed. Note that, when gas/liquid exchange between the liquid tank 3 and the liquid storage bottle 1 is realized by the liquid injection tube 4, one of the two dotted line arrows indicates a liquid flow, and the other indicates an air flow in the opposite direction.

Figure 3A:
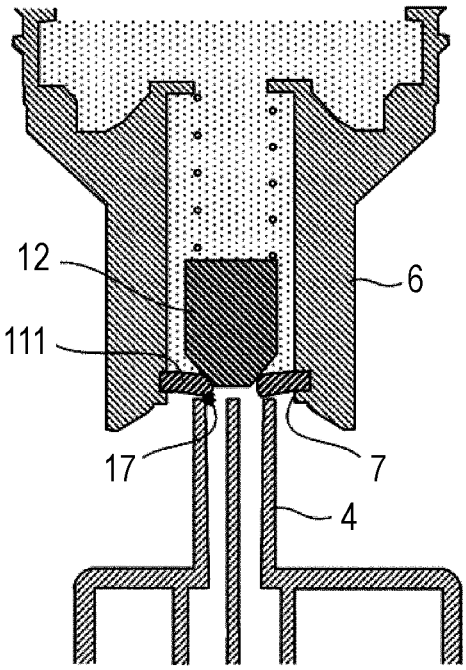
FIG. 3A and FIG. 3B are sectional views of a fixed seal member having a single seal portion.
Figure 3B:
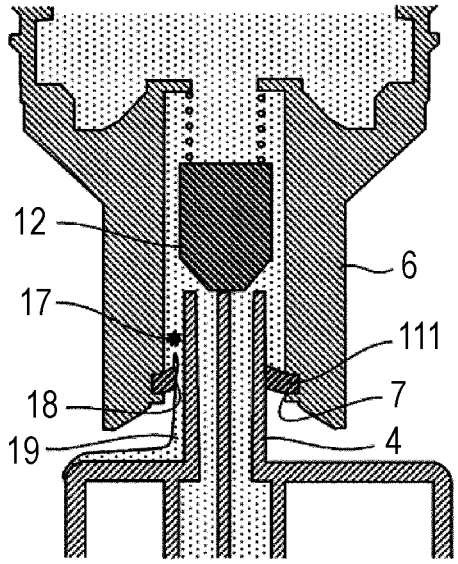
Figure 4A:
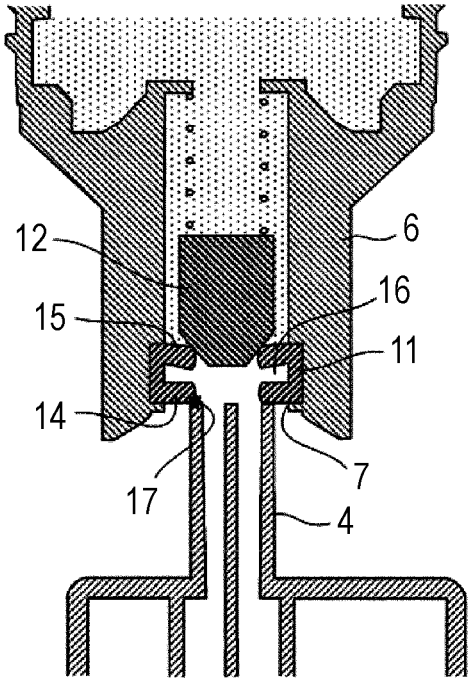
FIG. 4A and FIG. 4B are sectional views of a fixed seal member having two seal portions.
Figure 4B:
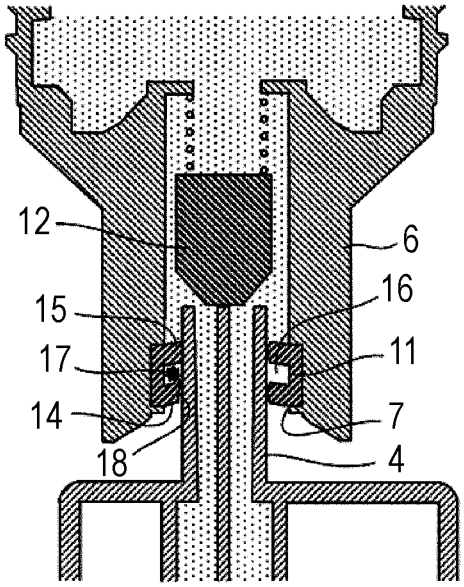

The fixed seal member 11 has the plurality of (two in the present embodiment) annular seal portions 14 and 15 that are arranged apart from each other in the axis direction of the discharge nozzle 6 and are individually in contact with the liquid injection tube 4 inserted in the discharge port 7, as illustrated in FIG. 2A and FIG. 2B. Advantageous effects resulted from such two seal portions 14 and 15 will be described below with reference to FIG. 3A, FIG. 3B, FIG. 4A, and FIG. 4B. FIG. 3A and FIG. 3B are sectional views illustrating a liquid replenishment operation using a fixed seal member of a comparative example having a single seal portion. FIG. 4A and FIG. 4B are sectional views illustrating a liquid replenishment operation using the fixed seal member of the present embodiment having two seal portions.

A fixed seal member 111 of the comparative example has a single seal portion that is in contact with the liquid injection tube 4 at a place in the axis direction when the liquid injection tube 4 is inserted. Thus, as illustrated in FIG. 3A, in a case where a foreign material 17 such as dust is involved when the liquid injection tube 4 is inserted, when even a single portion of a flaw 18 occurs in the fixed seal member 111, liquid leakage 19 may occur therefrom as illustrated in FIG. 3B. On the other hand, with the fixed seal member 11 of the present embodiment, a groove-shape recessed portion extending in the circumferential direction is formed between the two seal portions 14 and 15, and thereby a space 16 is formed between the inserted liquid injection tube 4 and the seal portions 14 and 15. Therefore, as illustrated in FIG. 4A, even when the foreign material 17 such as dust is involved when the liquid injection tube 4 is inserted, the foreign material 17 can be captured in the space 16 described above, as illustrated in FIG. 4B. Thus, further invasion of the foreign material 17 is suppressed, and damage of the second seal portion 15 is suppressed even when the flaw 18 is caused in the first seal portion 14 out of the two seal portions 14 and 15. As a result, a sealing performance between the discharge port 7 and the liquid injection tube 4 is ensured by the second seal portion 15, and leakage of the liquid inside the liquid storage bottle 1 to the outside is suppressed.

When the fixed seal member 11 has the two seal portions 14 and 15, it is preferable that the movable seal member 12 come into contact with only the second seal portion 15 out of the two seal portions 14 and 15 as with the present embodiment. Accordingly, it is possible to allow the two seal portions 14 and 15 to have respective different functions and improve reliability of the seal performance due to the fixed seal member 11.

For example, in the fixed seal member 111 of the comparative example illustrated in FIG. 3A and FIG. 3B, while there is a concern about deformation due to being continuously subjected to a load from the movable seal member 12 when an unused period is long, a load in the opposite direction is applied by the liquid injection tube 4 when used (during liquid replenishment). As a result, desired sealing performance may be unable to be exhibited during liquid replenishment. In contrast, with the fixed seal member 11 of the present embodiment, the movable seal member 12 comes into contact with only the second seal portion 15 out of the two seal portions 14 and 15. Thus, even when the liquid storage bottle 1 is unused for a long period, and the second seal portion 15 is deformed due to being continuously subjected to the load from the movable seal member 12, deformation of the first seal portion 14 that is not in contact with the movable seal member 12 is suppressed. As a result, it is possible to ensure sufficient sealing performance even when the first seal portion 14 is subjected to the load from the liquid injection tube 4 during liquid replenishment.

The shape or the thickness (the length in the axis direction) of the two seal portions 14 and 15 of the fixed seal member 11 may be the same as or different from each other, and the gap thereof (the size of the space 16) is not particularly limited. Note that, in the configuration in which the movable seal member 12 comes into contact with only the second seal portion 15 as with the present embodiment, deformation due to a load from the movable seal member 12 can be further suppressed by increasing the thickness of the second seal portion 15. Further, by widening a gap between the two seal portions 14 and 15 to secure the large space 16, the effect of capturing the foreign material 17 such as dust can be improved.

As the material forming the fixed seal member 11, an elastic material can be used, for example, an elastomer can be used. The elastic material may be a thermosetting resin such as urethane, a fluororubber, or a silicone rubber or a thermoplastic resin such as polyethylene, polyamide, polypropylene, or polystyrene.

Figure 5A:
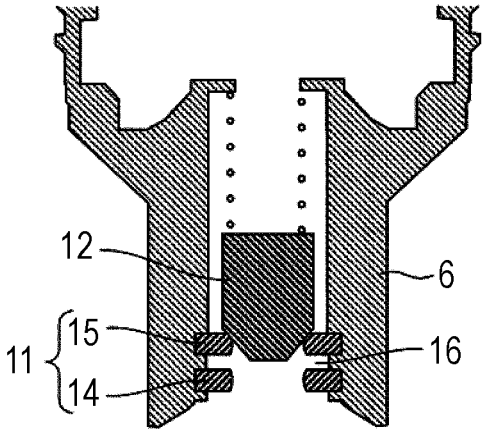
FIG. 5A, FIG. 5B, and FIG. 5C are sectional views illustrating modified examples of a fixed seal member of the present embodiment.
Figure 5B:
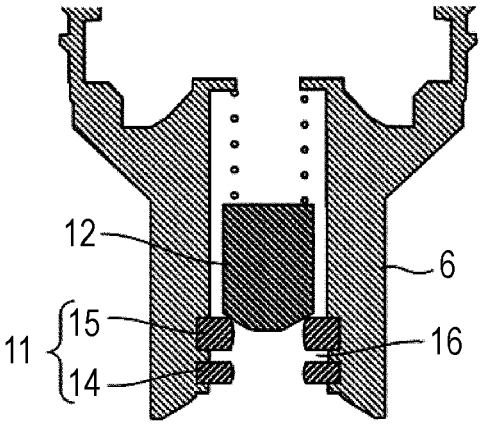
Figure 5C:
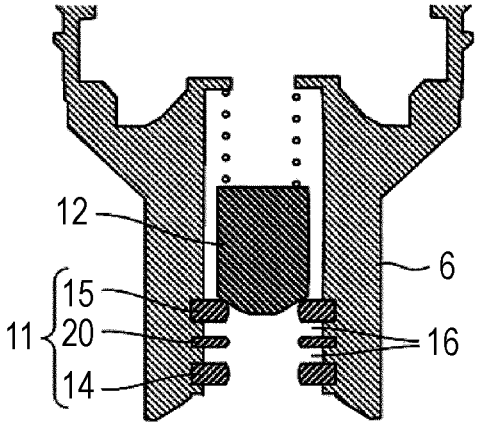

FIG. 5A to FIG. 5C are sectional views illustrating modified examples of a fixed seal member of the present embodiment.

In terms of suppressing an increase in the number of components, it is preferable that the two seal portions 14 and 15 of the fixed seal member 11 be integrally formed as with the embodiment described above. Note that, as illustrated in FIG. 5A, the two seal portions 14 and 15 may be separately formed as long as the two seal portions 14 and 15 are arranged apart from each other in the axis direction such that the space 16 for capturing the foreign material 17 such as dust is formed. In such a case, the same material or the same shape may be applied to the two seal portions 14 and 15. Note that, in the configuration in which the movable seal member 12 comes into contact with only the second seal portion 15 as described above, it is preferable that the second seal portion 15 be made of a harder material than the first seal portion 14. Further, as illustrated in FIG. 5B, it is preferable that the second seal portion 15 have a larger thickness than the first seal portion 14. In any case, when the liquid storage bottle 1 is unused for a long period, it is possible to further improve the effect of suppressing deformation of the second seal portion 15 due to the load from the movable seal member 12.

Further, the number of seal portions forming the fixed seal member 11 is not limited to two, may be three as illustrated in FIG. 5C, or may be three or greater, for example. As described above, when three or more seal portions 14, 15, and 20 are provided as the fixed seal member 11, better sealing performance can be exhibited to the liquid injection tube 4 during liquid replenishment. Note that, also in such a case, it is preferable that the movable seal member 12 come into contact with only the second seal portion 15 that is the closest to the movable seal member 12 out of the three seal portions 14, 15, and 20 for the above reasons. Therefore, in such a configuration, in the same manner as the embodiment described above, it is preferable that the second seal portion 15 be made of a harder material than the other seal portions 14 and 20 and have a larger thickness than the other seal portions 14 and 20. In addition, the first seal portion 14 located on the most tip side of the discharge nozzle 6 is subjected to a large load compared to the third seal portion 20 when the liquid injection tube 4 is inserted. Thus, it is preferable that the first seal portion 14 be made of a harder material than the third seal portion 20 and have a larger thickness than the third seal portion 20.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-026484, filed Feb. 19, 2020, which is hereby incorporated by reference herein in its entirety.

What is claimed is:

1. A liquid storage bottle for storing a liquid with which a liquid tank of a liquid ejection apparatus is to be replenished, the liquid storage bottle comprising:

a bottle body;

a discharge nozzle having a discharge port that discharges a liquid stored in the bottle body; and an annular fixed seal member, wherein the discharge nozzle is formed such that a liquid injection tube of the liquid tank is able to be inserted in the discharge nozzle via the discharge port, wherein the fixed seal member is provided in the discharge port and configured to seal a part between the discharge port and the liquid injection tube inserted in the discharge port, wherein in a direction to which the liquid injection tube is to be inserted, the discharge port, the fixed seal member, and the bottle body are arranged in this order, wherein the fixed seal member has a plurality of annular seal portions including a first seal portion and a second seal portion, and wherein the plurality of annular seal portions are arranged apart from each other in the axis direction of the discharge nozzle and configured to be in contact with the liquid injection tube individually, and in the direction to which the liquid injection tube is to be inserted, a space is provided between the first seal portion and the second seal portion.

2. The liquid storage bottle according to claim 1, wherein the discharge nozzle has a discharge channel that communicates with the discharge port, and the liquid storage bottle further comprising a movable seal member and a spring member, wherein the movable seal member is provided so as to be movable in the discharge channel in the axis direction of the discharge nozzle and configured to close the discharge port when coming into contact with the fixed seal member and open the discharge port when pressed by the liquid injection tube inserted in the discharge port and separated from the fixed seal member, and wherein the spring member is configured to push the movable seal member so that the movable seal member comes into contact with the fixed seal member.

3. The liquid storage bottle according to claim 2, wherein the movable seal member is configured to come into contact with only an annular seal portion which is the closest to the movable seal member out of the plurality of annular seal portions.

4. The liquid storage bottle according to claim 3, wherein the plurality of annular seal portions are formed integrally with each other.

5. The liquid storage bottle according to claim 4 further comprising a groove-shape recessed portion extending in the circumferential direction of the plurality of annular seal portions between the plurality of annular seal portions.

6. The liquid storage bottle according to claim 3, wherein the plurality of annular seal portions are formed separately from each other.

7. The liquid storage bottle according to claim 6, wherein an annular seal portion configured to be in contact with the movable seal member is made of a harder material than other annular seal portions.

8. The liquid storage bottle according to claim 7, wherein an annular seal portion located on the most tip side in the discharge nozzle out of the plurality of annular seal portions is made of a harder material than other annular seal portions excluding an annular seal portion configured to be in contact with the movable seal member.

9. The liquid storage bottle according to claim 4, wherein an annular seal portion configured to be in contact with the movable seal member has a larger thickness than other annular seal portions.

10. The liquid storage bottle according to claim 9, wherein an annular seal portion located on the most tip side of the discharge nozzle out of the plurality of annular seal portions has a larger thickness than other annular seal portions excluding an annular seal portion that is in contact with the movable seal member.

11. The liquid storage bottle according to claim 2, wherein in the direction to which the liquid injection tube is to be inserted, the liquid storage bottle comprises a discharge port, a plurality of annular seal portions, and a movable seal member in this order.

12. The liquid storage bottle according to claim 1, wherein the liquid tank is configured to supply the liquid to a liquid ejection head of the liquid ejection apparatus.

13. The liquid storage bottle according to claim 1, wherein the liquid storage bottle is configured to store an ink.

* * * * *